United States Patent [19]

Delacour et al.

[11] 3,999,565

[45] Dec. 28, 1976

[54] WALKING STICK DEVICE FOR ORTHOPEDIC USE

[76] Inventors: André Delacour, 3, rue Pasteur, Boissy-L'Aillerie, France; Francoise Delacour born Arnold, Les 4 Vents, Cauneille, France

[22] Filed: Sept. 3, 1975

[21] Appl. No.: 610,041

[52] U.S. Cl. ..... 135/65; 135/69

[51] Int. Cl.[2] ..... A45B 1/00; A45B 5/00

[58] Field of Search ..... 135/45 A, 47, 49; 297/5, 6, 433; 248/155; 272/70, 70.1, 70.2, 70.3

[56] References Cited

UNITED STATES PATENTS

| | | | |
|---|---|---|---|
| 1,463,675 | 7/1923 | Coleman | 135/49 |
| 2,495,889 | 1/1950 | Connaghan | 135/49 |
| 2,585,730 | 2/1952 | Bodnar | 135/49 |
| 2,778,370 | 1/1957 | Chamblee | 135/49 |
| 3,537,748 | 11/1970 | Knapp | 248/155 |
| 3,553,746 | 1/1971 | Seiger | 135/45 A |

*Primary Examiner*—Werner H. Schroeder
*Assistant Examiner*—Conrad L. Berman
*Attorney, Agent, or Firm*—Karl F. Ross; Herbert Dubno

[57] ABSTRACT

An orthopaedic device adapted to be used by a leg-injured or handicapped. It comprises a walking stick standard, a sleeve surrounding the standard, and a supporting member made of a padding-lined bracket hingedly attached to the sleeve, whereby said member is releasably mounted on said standard to lie therealong in its inoperative condition and to extend substantially perpendicularly thereto in its operative condition.

5 Claims, 4 Drawing Figures

WALKING STICK DEVICE FOR ORTHOPEDIC USE

The invention relates to a walking-stick device for orthopaedic use.

It is an object of the invention to provide a walking stick for orthopaedic use by means of which a leg-wounded or handicapped person can ambulate as usual with two such walking sticks while remaining easily in standing position by keeping his balance and have in such a position free use of his upper limbs.

The device for orthopaedic use according to the invention, which helps a leg-wounded or handicapped person to move about, featuring a standard to which is fastened in a retractable fashion a support member extending substantially perpendicularly to the standard in its operating condition to support knee or leg, is characterized by the fact that supporting said standard is that of a walking stick on which the said member comprises a bracket line with a foam padding or similar material is fastened at an adjustable height by means of a mounting sleeve.

In the following description, given by way of example, reference is made to the appended drawing wherein.

Figure 1:
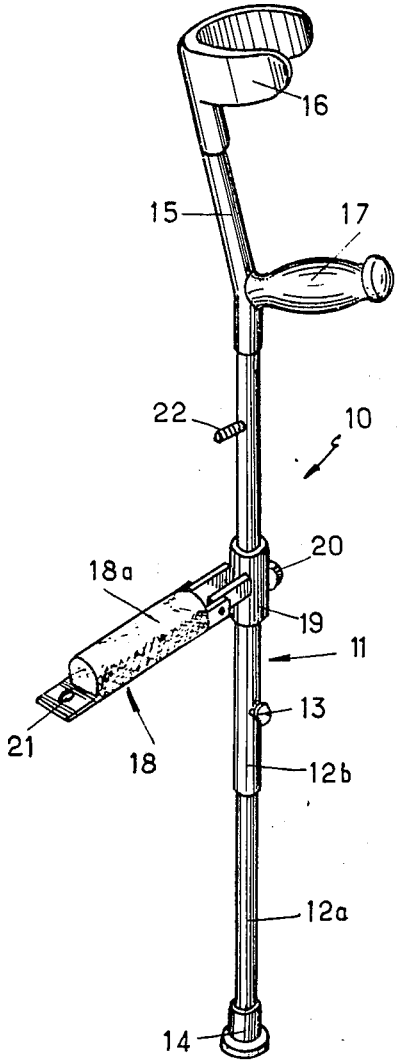
FIG. 1 is a perspective view of an orthopaedic walking stick according to the invention for a first embodiment.

Reference is first made to FIG. 1 which illustrates the invention as applied to an English-type of walking stick.

The stick 10 comprises a standard or body 11 made of the telescopic combination of an end part 12*a* fitted with a rubber foot 14 and of a tube 12*b*, the length of the standard being adjustable by means of a knurled knob 13.

The upper part of the walking stick 10 has a part 15 in inclined relation with the standard 11, the extremity remote from the standard having a lined or unlined hoop 16 for supporting the forearm, the usual handle 17 being provided substantially at the junction of part 15 and standard 11.

According to the invention, a member 18 for holding or supporting the wounded knee or leg is fitted on the standard 11 of the walking stick, the said member, made of a rigid bracket of adequate length lined at its outer part 18*a* with a padding of foam material or the like, extending substantially perpendicularly to the handle 17 and to the standard 11 of the walking stick, i.e. at 90° from the handle in the direction of use of this member 18.

To adjust the height of the member 18 with respect to the ground, this member is integral with a sleeve 19 which can be locked on the body 11 by means of a screw or clamping ring 20.

Due to the fact that member 18 for holding the wounded knee or leg is to be used temporarily only, for example when the wounded person wishes to remain motionless in standing position without excessive fatigue while being able to freely use his arms, the invention provides an hinged connection of member 18 on the sleeve 19, with or without a return spring; the support member 18 is, in its inoperative condition, laid along the standard 11 of the walking stick where it can be held by clamping its free extremity 21 on an appropriate member 22 of adjustable height on the standard 11 of the walking stick.

Figure 2:
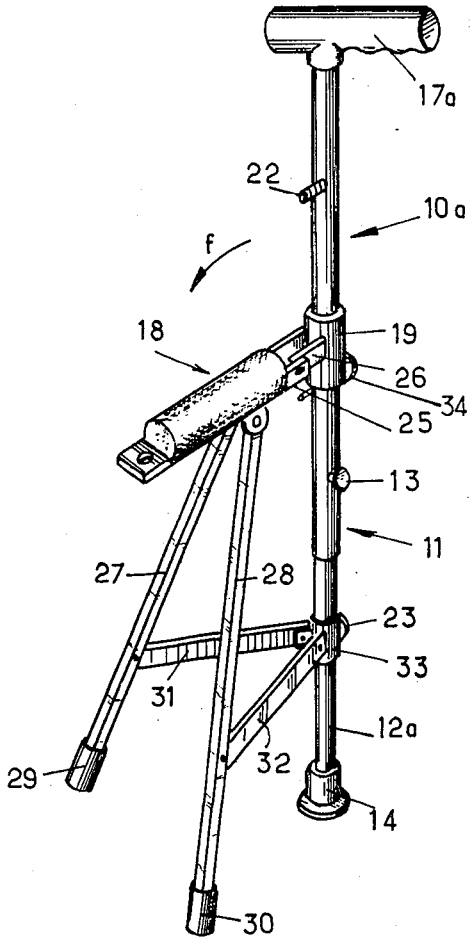
FIG. 2 is a view similar to FIG. 1 but for another embodiment as applied to an orthopaedic walking stick of the "Maginot"-type.

In the embodiment shown on FIG. 2, the walking stick 10*a* is of the "Maginot"-type, the parts thereof which are similar to the ones of the stick 10 of the previous embodiment bearing the same reference numerals, the stick 10*a* ending at its upper part in a handle 17*a* instead of a forearm holding part. In this embodiment, the walking stick comprises a member 18 for holding or supporting the wounded knee or leg, fitted on the body 11 of the walking stick and perpendicularly to the handle 17*a* by means of a sleeve 19 sliding on the body 11. The support member 18 which, in its inoperative condition, is laid against the standard 11, while being clamped thereon by an appropriate means 22, can be put in horizontal position and thus extend substantially perpendicularly to the body 11. One or more lugs 25 extend from member 18 toward sleeve 19 while the sleeve 19 is provided with one or more lugs 26 integral with said sleeve to pivotally support member 18 and hold it in a substantially horizontal position after its unfolding.

The upper ends of two struts 27 and 28 are hinged on the lower face of member 18, their lower ends having rubber feet 29 and 30; each of the struts is further provided with a spacer 31 and 32 respectively. The spacers are hinged on the strut and on a ring 33 fastened on the body 11 of the walking stick by means of a bolt or clamping bracket 23.

With such a walking stick, as long as member 18 for supporting the knee remains in its non-operating condition, the struts 27, 28 and the spacers 31, 32 are folded close to the standard 11 which can be then used as a walking stick. When member 18 is released, the opening and unfolding of the struts 27, 28 and of spacers 31, 32 are automatically obtained by the pivoting of member 18 in the direction of arrow *f* until the stops 25 rest against stops 26, and by the sliding motion of the sleeve 19 until it rests against a stop 34 of the body 11. The height of ring 33 on the standard 11 of the walking stick and the length of the struts 27 and 28 are choosen for the shoes 29 and 30 to be very close to the ground (in unfolded condition of the legs and when the walking stick is substantially vertical), so that it is possible, by slightly tilting the walking stick when the wounded knee or leg bears on member 18, to define through shoes 14, 29 and 30, an equilibrium triangle which allows to the user of the walking stick to remain without any difficulty in standing position while keeping his balance, and having thus free use of his hands, the weight of the body being distributed upon the legs 27, 28 and the standard 11 of the walking stick.

Figure 3:
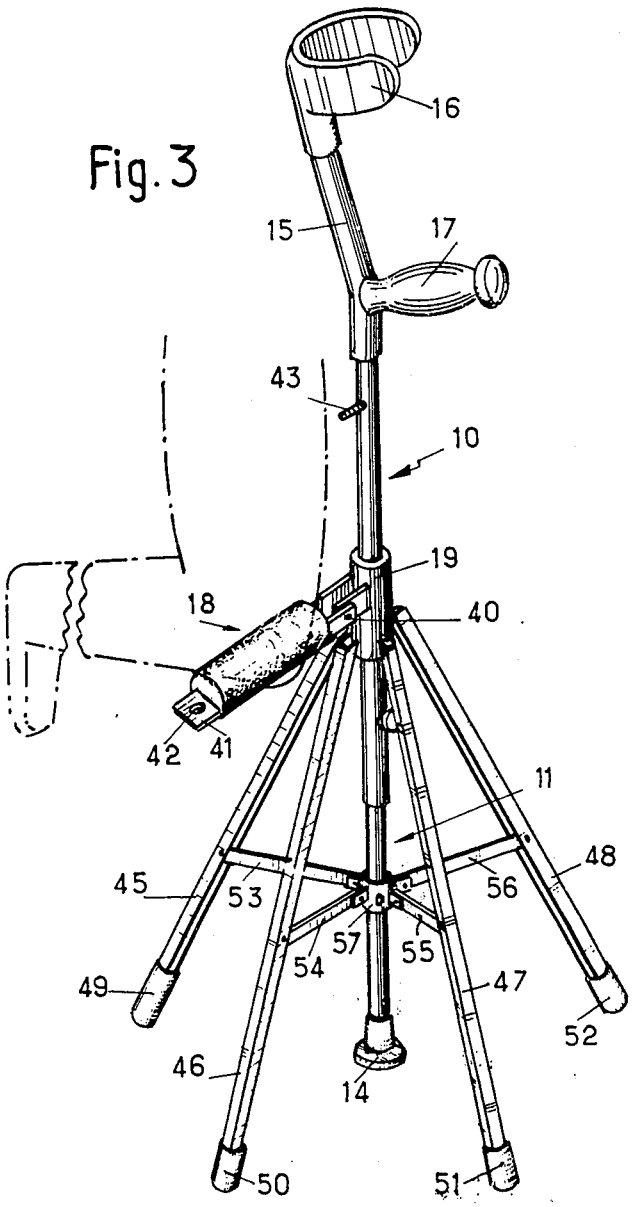
FIG. 3 is a view similar to both previous ones but illustrating still another embodiment.
Figure 4:
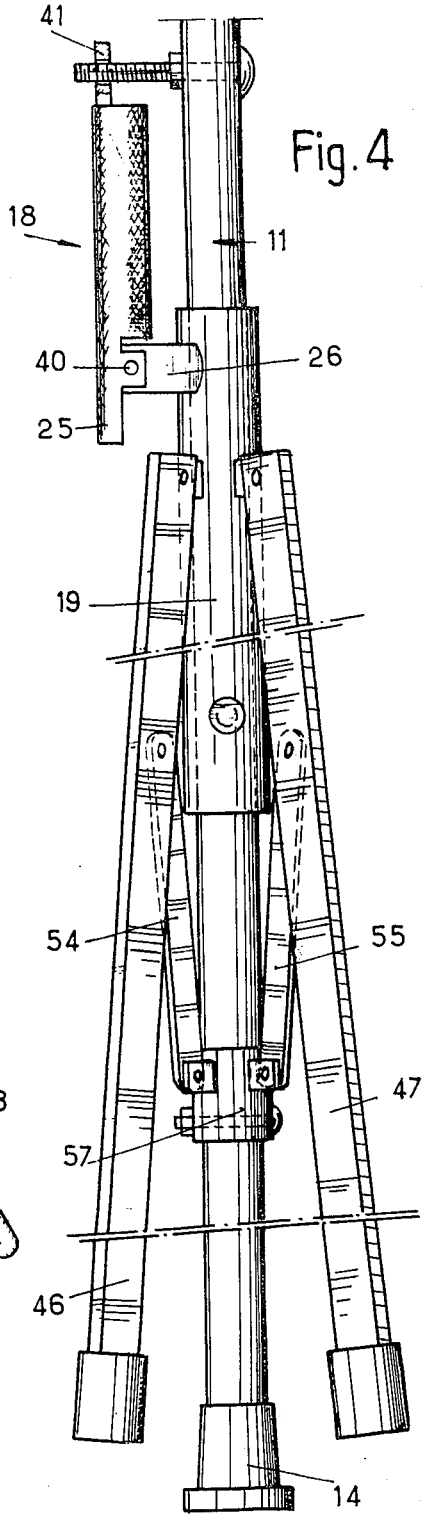
FIG. 4 is a partial view at greater scale of the walking stick illustrated on FIG. 3 in the folded condition of the leg means.

Reference is now made to FIGS. 3 and 4 relating to another embodiment.

In this embodiment, the walking stick is of the English type with a structure similar to the one illustrated in FIG. 1 and has a body or standard 11 the lower end of which has a foot 14. To a sleeve 19 which can slide on the body 11 of the walking stick is attached a member 18 for supporting the wounded knee or leg, the said member being hinged on the sleeve 19 about a pintel 40, FIG. 4, and having close to the shaft one or more tappets 25 adapted to cooperate with one or more stops 26 of the sleeve 19. At the end remote from the swivelling end, member 18 is fitted with a means such as a lug 41 with an eyelet 42 intended to cooperate with a pin 43 fastened on the standard, in order to be held against the standard 11 in its inoperative condition.

In this embodiment, four struts 45, 46, 47 and 48, fitted around the body 11, are hinged at one end on the sleeve 19 and have at their other end feet 49, 50, 51 and 52, made of rubber or similar material. Spacers 53, 54, 55 and 56 are hinged on each leg 45–48, at one of their ends and are at their other ends hinged on a collar 57 fitted to the body 11 of the walking stick.

When the walking stick is in the condition shown in FIG. 4, corresponding to its being used by a wounded or handicapped person for walking around, member 18 for holding the wounded knee or leg is maintained along the body 11 through cooperation of the eyelet 42 and pin 43.

Should the user of the walking stick wish to stay at a standstill without effort, he then releases member 18 which automatically leads to the unfolding of the struts 45–48 and of the associated spacers. The device is then as illustrated in FIG. 3, the walking stick being held in stable position on the ground through its four shoes 49–52 maintained by the weight of the wounded knee or leg and by the weight of the body on member 18 as schematically illustrated by dot-dash lines on FIG. 3. The user of the walking stick can then release the handle 17 to recover the free use of both arms and hands.

In the described and illustrated embodiments, the orthopaedic walking stick invention is shown as being a "left-side" walking stick. Obviously, the said walking stick can equally be a "right-side" walking stick, the conversion from one type to the other being most simply obtained by a 180° swivelling of the knee-rest unit or of the knee-rest-tripod unit about the standard of the walking stick.

The device according to the invention can also be used as a resting support when the wounded or handicapped is sitting and when his wounded leg rests on the holding member in unfolded condition, the wounded leg being in horizontal condition and the walking stick bearing on the ground through the tripod means.

We claim:

1. A walking stick comprising:
an upright standard;
an elongated handgrip fixed to said standard at an upper end thereof and projecting transversely from said standard;
a sleeve on said standard below said handgrip and adjustably positionable therealong;
a padded elongated knee-rest member swingably mounted on said sleeve at one end of said member, said member being pivotal between a substantially horizontal position wherein said member projects transversely away from said standard and is substantially orthogonal to said handgrip and a position wherein said member lies along said standard;
retaining means on said standard for releasably holding said member in the last-mentioned position thereof; and
a plurality of legs articulated to said standard and angularly spaced apart therealong while being operatively connected with said member and outward spreading upon displacement of said member into its transversely projecting position to form with said standard a polygon of support on the ground, said legs being retractable upwardly and inwardly toward said standard and each other upon displacement of said member to lie along said standard and engagement by said retaining means.

2. The walking stick defined in claim 1 wherein said standard is provided below said sleeve with a collar, a respective bar being swingably mounted on said collar and articulated to each of said legs.

3. The walking stick defined in claim 2, further comprising means pivotally connecting each of said legs at the upper end thereof to said member.

4. The walking stick defined in claim 2, further comprising means pivotally connecting each of said legs at the other end thereof to said sleeve.

5. The walking stick defined in claim 4 wherein four such legs are provided in angularly spaced relationship around said standard.

* * * * *